US010407819B2

(12) United States Patent
Chua et al.

(10) Patent No.: US 10,407,819 B2
(45) Date of Patent: Sep. 10, 2019

(54) GARMENT STEAMING DEVICE WITH VALVE ASSEMBLY FOR A FRAGRANCE CARTRIDGE

(71) Applicant: KONINKLIJKE PHILIPS N.V., Eindhoven (NL)

(72) Inventors: Hee Keng Chua, Eindhoven (NL); Lihong Zhao, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/508,517

(22) PCT Filed: May 19, 2016

(86) PCT No.: PCT/EP2016/061241
§ 371 (c)(1),
(2) Date: Mar. 3, 2017

(87) PCT Pub. No.: WO2016/184957
PCT Pub. Date: Nov. 24, 2016

(65) Prior Publication Data

US 2018/0073190 A1 Mar. 15, 2018

(30) Foreign Application Priority Data

May 20, 2015 (EP) ..... 15168317

(51) Int. Cl.
*D06F 73/00* (2006.01)
*D06F 87/00* (2006.01)
*D06F 75/00* (2006.01)

(52) U.S. Cl.
CPC ..... *D06F 73/00* (2013.01); *D06F 75/00* (2013.01); *D06F 87/00* (2013.01)

(58) Field of Classification Search
CPC ..... D06F 73/00; D06F 75/00; D06F 87/00
See application file for complete search history.

(56) References Cited

U.S. PATENT DOCUMENTS 3,263,350 A * 8/1966 Salomon ..... D06F 75/12 38/77.7
5,138,778 A * 8/1992 Brandolini ..... D06F 75/14 210/282

(Continued)

FOREIGN PATENT DOCUMENTS

DE 29601699 U1 6/1997
DE 19834605 A1 2/2000

*Primary Examiner* — Joseph L. Perrin

(57) ABSTRACT

The present application relates to a garment steaming device (1). The garment steaming device comprises a housing (2) with a steam channel (8) arranged in the housing (2) for the passage of steam and a cavity extending into the housing (2). The garment steaming device (1) further comprises a fragrance cartridge (10) that is removeably disposed in the cavity and a valve assembly (11) which is disposed between the cavity and the steam channel (8). The valve assembly (11) is adapted to prevent steam to from flowing between the steam channel (8) and the cavity when the fragrance cartridge (10) is not disposed in the cavity. The valve assembly and the fragrance cartridge are adapted to cooperate such as to allow steam to flow between the steam channel and the cavity when the fragrance cartridge is disposed in the cavity. This solution allows a user to safely remove the fragrance cartridge from the cavity even when there is steam in the steam channel.

15 Claims, 7 Drawing Sheets

(56) References Cited

U.S. PATENT DOCUMENTS

| | | | | |
|---|---|---|---|---|
| 6,351,901 | B1 | 3/2002 | Amsel | |
| 6,625,910 | B2 | 9/2003 | Ching | |
| 7,065,907 | B2 | 6/2006 | Valiyambath Krishnan | |
| 7,451,559 | B2 * | 11/2008 | Chen | D06F 75/14 38/77.3 |
| 8,109,017 | B2 * | 2/2012 | Ji | F22B 1/284 210/282 |
| 2001/0042326 | A1 * | 11/2001 | Ching | D06F 75/14 38/77.3 |
| 2002/0050081 | A1 * | 5/2002 | Ching | D06F 75/14 38/77.3 |
| 2005/0217152 | A1 | 10/2005 | Pessayre | |

* cited by examiner

GARMENT STEAMING DEVICE WITH VALVE ASSEMBLY FOR A FRAGRANCE CARTRIDGE

This application is the U.S. National Phase application under 35 U.S.C. § 371 of International Application No. PCT/EP2016/061241, filed on May 19, 2016, which claims the benefit of International Application No. 15168317.4 filed on May 20, 2015. These applications are hereby incorporated by reference herein.

FIELD OF THE INVENTION

The present invention relates to a garment steaming device, in particular a steaming device with a valve assembly for a fragrance cartridge.

BACKGROUND OF THE INVENTION

It is known that ironing a fragrance into a garment will result in the fragrance being released from the garment for an extended period of time. For example, the garment can be pre-sprayed with a liquid fragrance prior to ironing. However, pre-spraying the garment is time consuming and may result in the liquid fragrance staining the garment.

Fragrance may also be imparted to the garment by pouring drops of a fragranced essential oil into the water tank of the steam iron. Therefore, when the steam iron is operated, the liquid water in the water tank is evaporated and is imparted with the fragrance of the essential oil. However, it is difficult for the user to judge how much essential oil should be added to the water tank. Furthermore, the essential oil in the water tank does not evaporate with the water and so most of the essential oil remains in the water tank and thus the steam does not have a strong fragrance. Additionally, the water tank needs to be completely emptied of liquid water and essential oil before a different fragrance is used.

Some alternative solutions consist in using capillary device for the release of additive to the steam. However, this type of solutions creates some risks for the end-user when changing the capillary device, in view that the steam may flow in direction of the end-user.

It is known from DE19834605 to provide a garment steaming device comprising a housing; a steam channel arranged in the housing for the passage of steam; a cavity extending into the housing; a fragrance cartridge removeably disposed in the cavity; and a valve assembly disposed between the cavity and the steam channel, the valve assembly being adapted to prevent steam from flowing between the steam channel and the cavity when the fragrance cartridge is not disposed in the cavity.

SUMMARY OF THE INVENTION

It is an object of the invention to provide a garment steaming device which substantially alleviates or overcomes the problems mentioned above.

The invention is defined by the independent claims. The dependent claims define advantageous embodiments.

According to the present invention, there is provided a garment steaming device comprising: a housing; a steam channel arranged in the housing for the passage of steam; a cavity extending into the housing; a fragrance cartridge removeably disposed in the cavity; and, a valve assembly disposed between the cavity and the steam channel, the valve assembly being adapted to prevent steam from flowing between the steam channel and the cavity when the fragrance cartridge is not disposed in the cavity. The valve assembly and the fragrance cartridge are adapted to cooperate such as to allow steam to flow between the steam channel and the cavity when the fragrance cartridge is disposed in the cavity.

When the fragrance cartridge is received in the cavity, steam is able to flow into the cavity such that fragrance is imparted to the steam. The valve assembly is arranged to prevent hot steam from escaping out of the cavity to burn the user when the fragrance cartridge is removed from the cavity. Therefore, it is possible for the user to safely remove the fragrance cartridge from the cavity even when there is steam in the steam channel.

In addition, since the fragrance cartridge is received in the cavity rather than the steam channel, there is less chance of the steam channel becoming contaminated by the fragrance. For example, if the fragrance cartridge was instead received in the steam channel then fragrance may drip into the steam channel such that fragrance is still imparted to the steam in the steam channel after the fragrance cartridge has been removed therefrom. The cavity of the garment steaming device of the present invention is sealed from the steam channel when the fragrance cartridge is removed from the cavity such that, even if the cavity becomes contaminated with fragrance, the fragrance will not be imparted to the steam in the steam channel when the fragrance cartridge is removed from the cavity.

In one embodiment, the valve assembly comprises a valve member and a valve seat, the valve member being movable to take a first position in which the valve member is away from the valve seat to allow steam to flow between the steam channel and the cavity, and a second position in which the valve member is in contact with the valve seat to prevent steam from flowing between the steam channel and the cavity. The valve member may comprise a valve head arranged at an end of the valve member proximate to the steam channel, wherein the valve head is configured to contact the valve seat to prevent steam from flowing between the steam channel and the cavity when the valve member is in said second position.

The valve assembly arrangement means that it is not necessary for the fragrance cartridge to extend into the steam channel and therefore the fragrance cartridge does not have to rely on a capillary action to impart fragrance to the steam.

The valve assembly may comprise a retention member to maintain the valve head in contact with the valve seat when the valve member is in said second position. The retention member may comprise a spring. The retention member helps to ensure that the steam channel is sealed from the cavity when the fragrance cartridge is removed from the cavity.

The valve member may comprise a hollow structure to carry steam between the steam channel and the cavity. This allows for steam to flow through a portion of the valve member when the fragrance cartridge is received in the cavity such that no separate means of fluidly communicating the steam channel with the cavity is required.

In one embodiment, the garment steaming device comprises a supporting element that is disposed at an end of the cavity distal to the steam channel and is configured such that the fragrance cartridge abuts the supporting element when the fragrance cartridge is disposed in the cavity. The supporting element helps to ensure that the fragrance cartridge stays in position relative to the cavity when the fragrance cartridge is received in the cavity.

The fragrance cartridge may comprise a fragrance receiving element and a holder to hold the fragrance receiving element. Therefore the user does not need to touch the fragrance receiving element when moving the fragrance cartridge. The holder may comprise a peripheral wall that extends in the cavity when the fragrance cartridge is received in the cavity, wherein the peripheral wall defines a recess for receiving the fragrance receiving element.

In one embodiment, wherein the valve member comprises a valve plunger extending in the cavity, wherein the valve plunger and the peripheral wall of the holder having cumulated lengths along the central axis of the cavity such that the fragrance cartridge urges the valve head away from the valve seat when the valve member is in the first position.

In one embodiment, the peripheral wall of the holder comprises a protrusion structure at an end facing the plunger, the protrusion structure forming an opening for the steam to get into contact with the fragrance receiving element when the peripheral wall of the holder is in contact with the plunger when the valve member is in the first position. The protrusion structure may increase the surface area of the fragrance receiving element that is in contact with the steam in the cavity when the fragrance cartridge is received in the cavity such that the rate at which fragrance is imparted to the steam is increased.

The peripheral wall of the holder may comprise at least one hole forming an opening for the steam to get into contact with the fragrance receiving element when the valve member is in the first position. The hole in the peripheral wall of the holder may increase the surface area of the fragrance receiving element that is in contact with the steam in the cavity when the fragrance cartridge is received in the cavity such that the rate at which fragrance is imparted to the steam is increased.

The peripheral wall of the holder may comprise a shoulder element to retain the retention member, the shoulder element comprising at least one hole forming an opening to allow steam to flow between the steam channel and the cavity. Thus, the means for fluidly communicating the steam channel with the cavity when the fragrance cartridge is received in the cavity is combined with the shoulder element.

The fragrance cartridge may comprise a handle that is hingedly attached to the holder. The user may grip the handle to manipulate the fragrance cartridge.

The garment steaming device may further comprise a locking means to lock the fragrance cartridge in the cavity. The locking means may comprise a portion of the housing and a portion of the fragrance cartridge that engage when the fragrance cartridge is received in the cavity. The locking means reduces the likelihood of accidental removal of the fragrance cartridge from the cavity.

In one embodiment, the locking means comprises a locking recess that extends into the handle and a locking protrusion that is fixed relative to the housing. The locking protrusion is configured to be received in the locking recess. The locking recess may be generally U-shaped. The handle is moveable between a first position, wherein the locking protrusion is held in place in the locking recess, and a second position, wherein the locking protrusion is removable from the locking recess. In another embodiment, the locking means comprises a plurality of locking recesses that each receives a corresponding locking protrusion.

In one embodiment, the garment steaming device comprises a seal. The seal may comprise a sealing gasket. The sealing gasket may circumscribe a peripheral wall of the fragrance cartridge when the fragrance cartridge is received in the cavity. The seal may be configured to seal an end of the cavity when the fragrance cartridge is received in the cavity. In one embodiment, the seal is fixed relative to the cavity. In an alternative embodiment, the seal is fixed relative to the fragrance cartridge.

In one embodiment, the garment steaming device comprises an inner collar defining walls of the cavity. An end of the inner collar may comprise the valve seat. The garment steaming device may further comprise a conduit which is disposed in the housing and defines the steam channel, wherein the conduit comprises an opening and the inner collar extends through the opening in the conduit.

In one embodiment, the garment steaming device is a steamer head.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
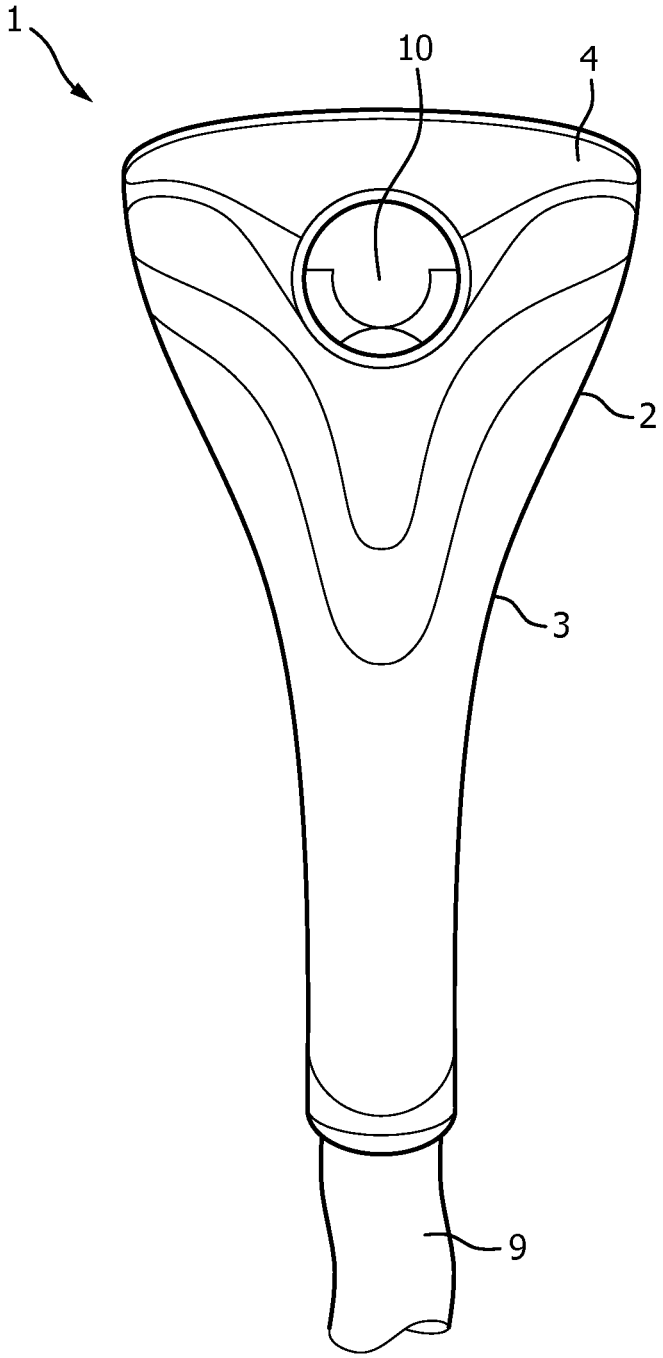
FIG. 1 is a top view of a garment steaming device according to an embodiment of the invention.
Figure 2:
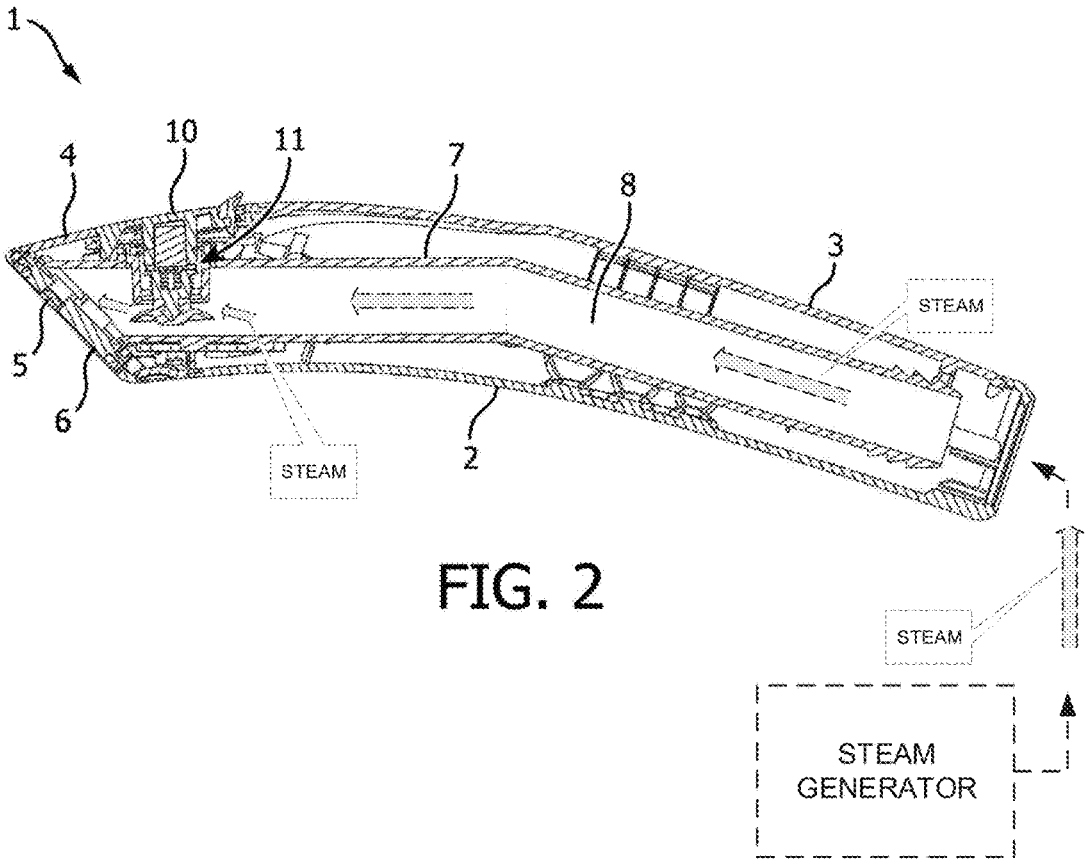
FIG. 2 is cross-sectional side view of the garment steaming device of FIG. 1.
Figure 3:
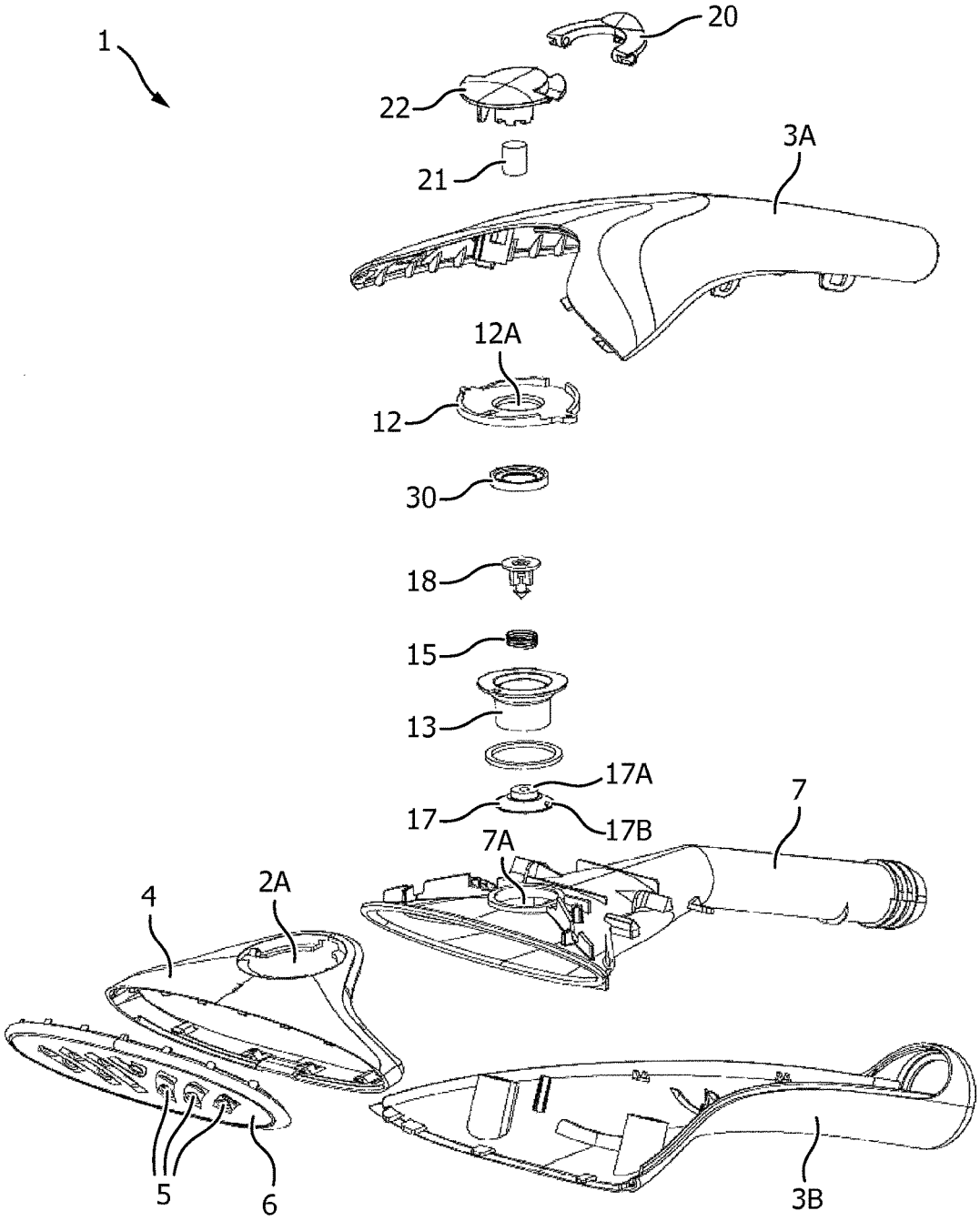
FIG. 3 is an assembly view of the garment steaming device of FIG. 1.

Referring now to FIGS. 1 to 8, a garment steaming device 1 according to an embodiment of the invention is shown. The garment steaming device 1 is in the form of a steamer head 1.

The garment steaming device 1 comprises a housing 2. For example, the housing 2 has a body 3 and a steam nozzle 4 connected to the body 3. For example, the steam nozzle 4 includes a plurality of vents 5 in an end face 6 of the steam nozzle 4, through which steam is expelled when in use. For example, the body 3 comprises first and second portions 3A, 3B that are attached together and to the steam nozzle 4 to form the housing 2. For example, the steam nozzle 4 comprises an aperture that forms an opening 2A in the housing 2. The steam duct 7 comprises an aperture that forms an opening 7A in the steam duct 7. The openings 2A, 7A in the housing 2 and steam duct 7 are generally circular and are concentrically aligned.

The garment steaming device 1 also comprises a steam channel 8 arranged in the housing 2 for the passage of steam. The channel 8 defines a steam duct 7. The steam duct 7 extends within housing 2 to convey steam through the garment steaming device 1 to the steam nozzle 4. In use, a steam supply hose 9 (shown in FIG. 1) is connected to the steam duct 7 of the garment steaming device 1 to supply steam to the garment steaming device 1 from a steam generator (not shown) such that steam travels along the steam channel 8 to be expelled through the vents 5 of the steam nozzle 4.

The garment steaming device 1 also comprises a cavity 16 extending into the housing 2. For example, the cavity 16 is defined by an inner collar 13 comprising a cylindrical peripheral wall 13A. The peripheral wall 13A extends from the outer collar 12 in a direction away from the opening 2A in the housing 2. The outer collar 12 thus forms a flange at an end of the inner collar 13. The inner collar 13 protrudes through the opening 7A in the steam duct 7 to extend into the steam channel 8.

The garment steaming device 1 also comprises a fragrance cartridge 10 removeably disposed in the cavity 16.

The garment steaming device 1 also comprises a valve assembly 11 disposed between the cavity 16 and the steam channel 8. For example, the valve assembly 11 comprises outer and inner collars 12, 13, a valve member 14, and a retention member 15.

The valve assembly 11 and the fragrance cartridge 10 are adapted to cooperate such as to allow steam to flow between the steam channel 8 and the cavity 16 when the fragrance cartridge 10 is disposed in the cavity 16. The valve assembly 11 is also adapted to prevent steam from flowing between the steam channel 8 and the cavity 16 when the fragrance cartridge 10 is not disposed in the cavity 16. The outer collar 12 is disposed between the housing 2 and the steam duct 7. The outer collar 12 is generally flat and is annular, having an aperture 12A that is concentrically aligned with the openings 2A, 7A in the housing 2 and steam duct 7.

The inner collar 13 further comprises a lip 13B that extends radially inwardly from the peripheral wall 13A. The lip 13B is disposed towards the end of the inner collar 13 that is distal to the outer collar 12. The lip 13B defines an end of the cavity 16. The aperture 12A in the outer collar 12 is located at the other end of the cavity 16.

The valve member 14 comprises a valve head 17 and a valve plunger 18 that is connected to the valve head 17. The valve head 17 comprises a cylindrical body portion 17A with a flanged base 17B at one end.

The valve plunger 18 comprises a body portion 18A, a base 18B and a plurality of spaced connecting members 18C. The connecting members 18C extend between the body portion 18A and the base 18B to connect the body portion 18A to the base 18B. The connecting members 18C are spaced about the central axis A-A of the cavity 16.

The body portion 18A of the valve plunger 18 is received in a recess in the body portion 17A of the valve head 17 such that the valve plunger 18 and valve head 17 are secured together by an interference fit. Therefore, the valve plunger 18 is fixed relative to the valve head 17. The connecting members 18C extend from the base 18B of the valve plunger and abut the body portion 17A of the valve head 17. Steam is able to flow between the connecting members 18C and through an aperture 18D in the base 18B of the valve plunger 18. Thus, the valve plunger 18 forms a hollow structure that permits the flow of steam therethrough.

Figure 5:
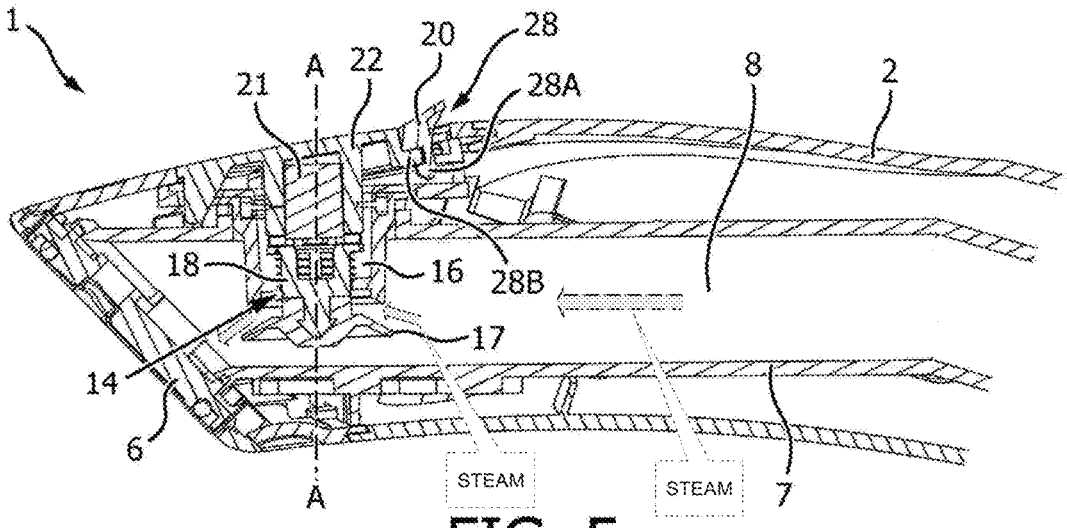
FIG. 5 is a cross-sectional side view of the garment steaming device of FIG. 1, with the fragrance cartridge inserted into the cavity.

The valve member 14 extends in the cavity 16 in the direction of the central axis A-A of the cavity 16 (as shown in FIG. 5). The valve member 14 is moveable relative to the inner collar 13 in the direction of the central axis A-A of the cavity 16. The valve member 14 extends between the cavity 16 and the steam channel 8 and is surrounded by the lip 13B of the inner collar 13. The base 18B of the valve plunger 18 is received in the cavity 16 and the base 17B of the valve head 17 is disposed in the steam channel 8, on the other side of the lip 13B to the base 18B of the valve plunger 18.

The retention member 15 is in the form of a helical spring 15. The spring 15 extends about the central axis A-A of the cavity 16 to surround the connecting members 18C. The spring 15 is located between the base 18B of the valve plunger 18 and the lip 13B of the inner collar 13. The spring 15 is compressed between the base 18B of the valve plunger 18 and the lip 13B when the base 17B of the valve head 17 is moved away from the inner collar 13 such that the spring 15 biases the base 17B of the valve head 17 against the inner collar 13.

Figure 4:
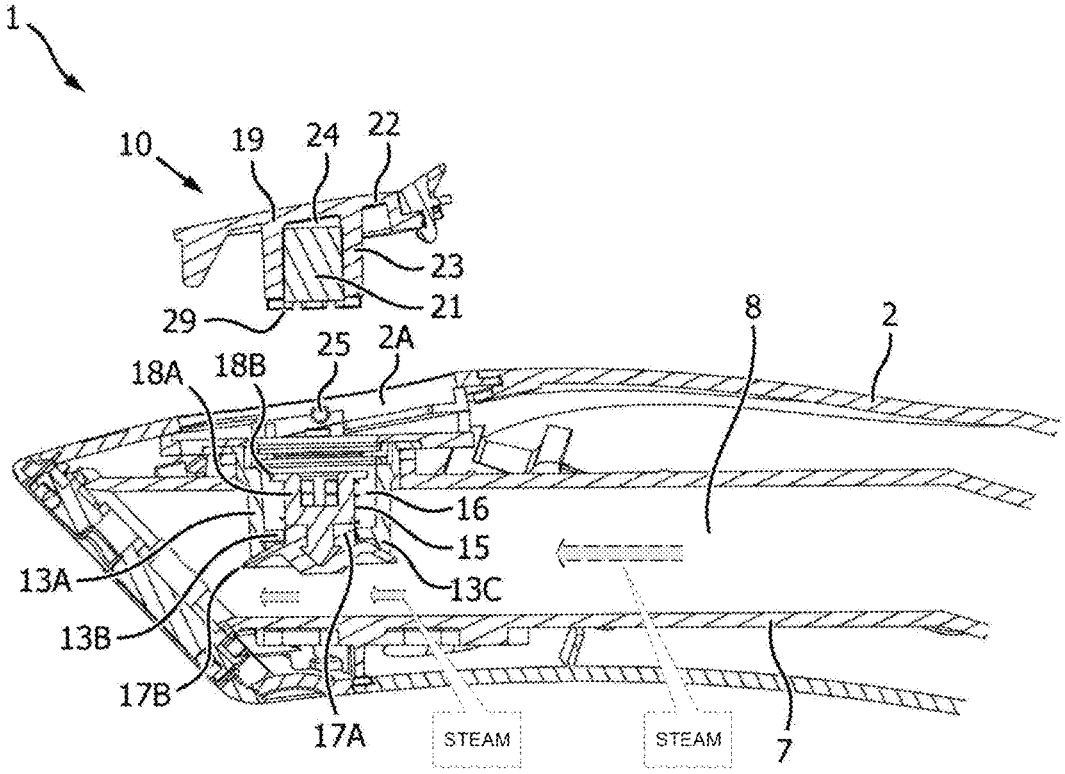
FIG. 4 is a cross-sectional side view of the garment steaming device of FIG. 1, with a fragrance cartridge removed from a cavity in the garment steaming device.

The end of the inner collar 13 that is distal to the outer collar 12 forms an annular valve seat 13C. The base 17B of the valve head 17 is biased against the valve seat 13C by the spring 15 such that the valve member 14 is urged into a closed position (as shown in FIG. 4). When the valve member 14 is in the closed position, the valve head 17 seals the cavity 16 from the steam channel 8.

The fragrance cartridge 10 comprises a holder 19, a handle 20 and a fragrance receiving element 21. The holder 19 comprises a generally flat base 22 and a peripheral wall 23. The base 22 is shaped to be received in the opening 2A in the housing 2. The peripheral wall 23 extends from the base 22 and defines a recess 24 for receiving the fragrance receiving element 21.

The fragrance receiving element 21 may comprise a porous material. In the present embodiment, the porous material comprises foam. However, it should be recognised that the fragrance receiving element 21 may comprise a different porous material, for example, cork or fabric.

Figure 6:
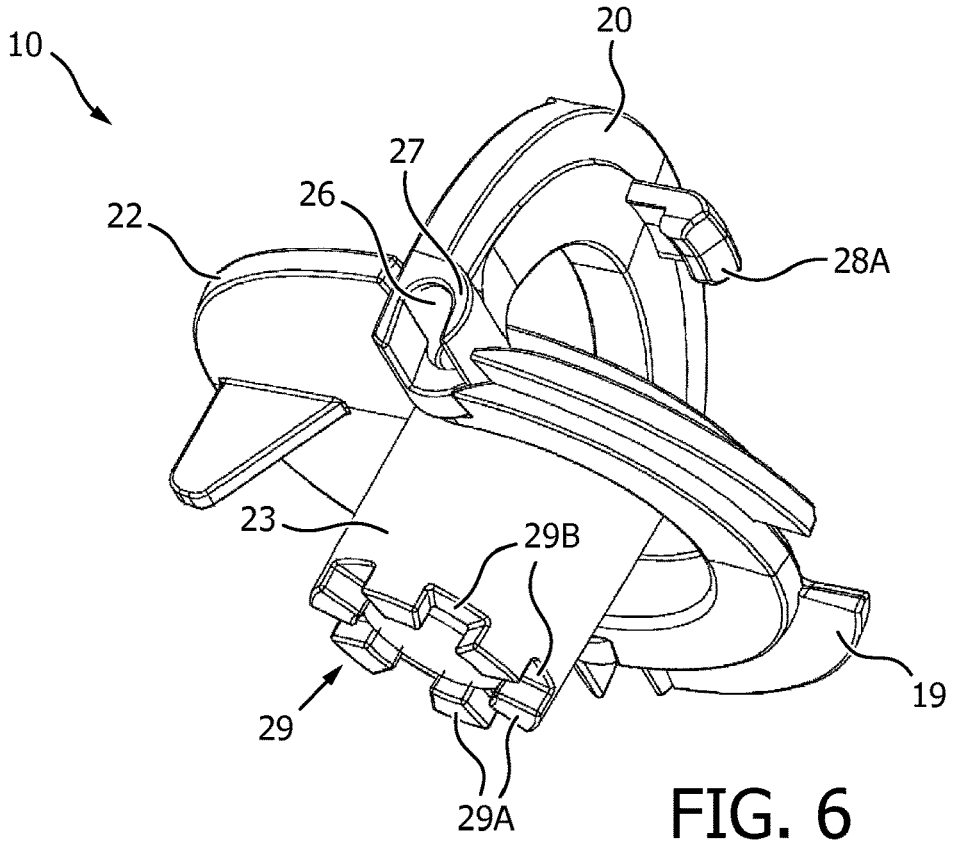
FIG. 6 is a perspective view of a fragrance cartridge of the garment steaming device of FIG. 1, with a handle in an extended position.
Figure 7:
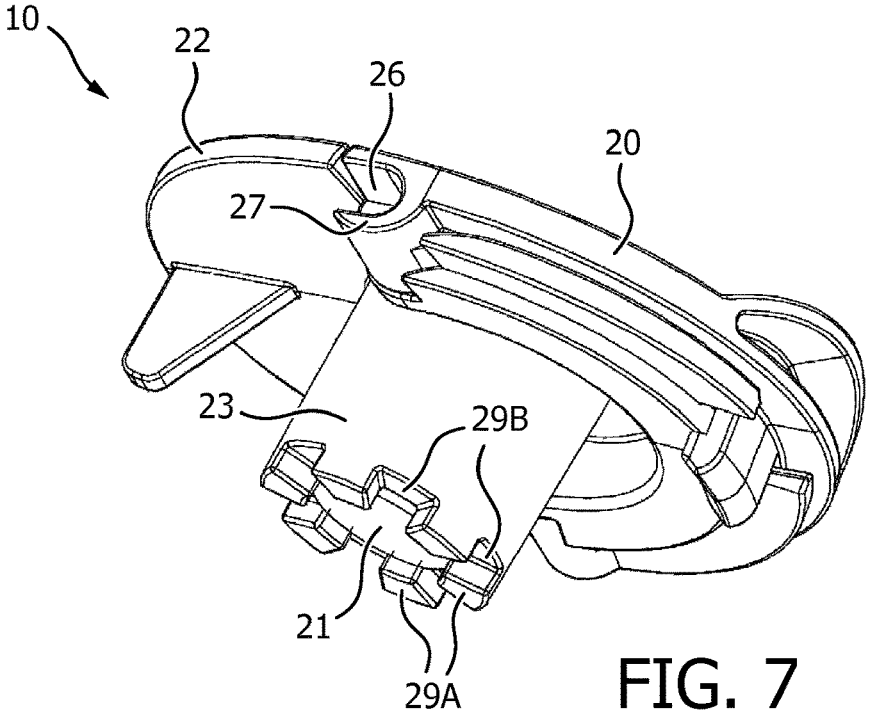
FIG. 7 is a perspective view of the fragrance cartridge of FIG. 6, with the handle in a stowed position.
Figure 8:
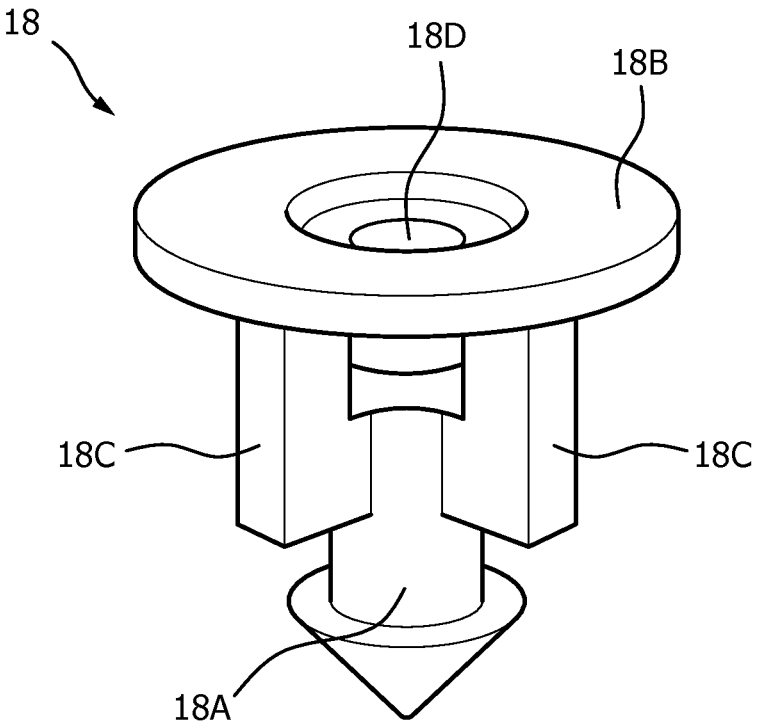
FIG. 8 is a perspective view of a valve plunger of the garment steaming device of FIG. 1.

The handle 20 is hingedly attached to the base 22 of the holder 19 such that the handle 20 is moveable relative to the base 22 between an extended position (shown in FIG. 6) and a stowed position (shown in FIG. 7). The handle 20 is generally U-shaped. The handle 20 is received in the opening 2A in the housing 2 to sit flush to the base 22 of the holder 19 when in the stowed position. The handle 20 projects from the base 22 when in the extended position such that it can be gripped by the user to facilitate insertion and removal of the fragrance cartridge 10 from the cavity 16.

The garment steaming device 1 comprises a locking means that is configured to releasably hold the fragrance cartridge 10 in the cavity 16 when the handle 20 in the stowed position. The locking means comprises a first locking protrusion (not shown) and a second locking protrusion 25. The first and second locking protrusions 25 are fixed relative to the housing 2 and extend radially into the opening 2A of the housing 2. The first and second locking protrusions 25 are arranged on opposite sides of the opening 2A in the housing 2.

The locking means further comprises a first locking recess 26 and a second locking recess (not shown). The first and second locking recesses 26 extend into distal ends of the handle 20 of the fragrance cartridge 10 that are each hingedly attached to the base 22 of the holder 19. Thus, the first and second recesses 26 are rotatable about the hinge axis of the attachment between the handle 20 and the base 22 of the holder 19 when the handle 20 is rotated relative to the base 22. The first and second locking recesses 26 are generally U-shaped.

The first and second locking recesses 26 are configured to receive the first and second locking protrusions 25 respectively when the fragrance cartridge 10 is received in the cavity 16. When the handle 20 is in the extended position (as shown in FIG. 6), the first and second locking recesses 26 are orientated such that the first and second locking protrusions 25 can be received in and removed from the corresponding first and second locking recesses 26 such that the fragrance cartridge 10 can be received in and removed from the cavity 16. More specifically, the open end of each U-shaped first and second locking recess 26 faces in the direction of the central axis A-A of the cavity 16 when the fragrance cartridge 10 is received in the cavity 16 and the handle 20 is in the extended position.

When the handle 20 is moved to the stowed position (as shown in FIG. 7), the first and second locking recesses 26 are orientated such that the first and second locking protrusions 25 are prevented from being removed from the first and second locking recesses 26 respectively such that the fragrance cartridge 10 is held in place in the cavity 16. More specifically, the open end of each U-shaped first and second locking recess 26 faces generally perpendicularly to the direction of the central axis A-A of the cavity 16 when the fragrance cartridge 10 is received in the cavity 16 and the handle 20 is in the stowed position. Therefore, if the fragrance cartridge 10 is urged out of the cavity 16, the first and second locking protrusions 25 are urged against a corresponding side wall 27 of the first and second locking recesses 26 respectively such that movement of the fragrance cartridge 10 out of the cavity 16 is prevented.

To remove the fragrance cartridge 10 from the cavity 16, the handle 20 is moved to the extended position such that the first and second locking recesses 26 are orientated such as to allow movement of the fragrance cartridge 10 relative to the first and second locking protrusions 25.

The garment steaming device 1 comprises a latch 28 that prevents accidental movement of the handle 20 from the stowed position to the extended position. The latch 28 comprises first and second latch elements 28A, 28B that engage when the handle 20 is in the stowed position. The first latch element 28A projects from the handle 20 and the second latch element 28B projects from the base 22 of the holder 19. The user must exert sufficient force on the handle 20 to disengage the first and second latch elements 28A, 28B to move the handle 20 from the stowed position to the extended position. It should be recognised that other configurations of latch 28 are intended to fall within the scope of the invention. For example, in an alternative embodiment (not shown) the second latch element instead comprises a recess that is configured to frictionally receive the first latch element to hold the handle in the stowed position.

In use, the user supplies a few drops of liquid fragrance to the fragrance receiving element 21 with the fragrance cartridge 10 removed from the cavity 16. The porous material of the fragrance receiving element 21 absorbs the drops of liquid fragrance. The fragrance may comprise, for example, an essential oil or perfume.

Once the user has supplied fragrance to the fragrance receiving element 21, the user grips the handle 20, which is initially in the extended position, and manipulates the fragrance cartridge 10 such that the peripheral wall 23 of the holder 19 is inserted into the cavity 16 in the garment steaming device 1. Therefore, the fragrance receiving element 21 is located in the cavity 16. The base 22 of the holder 19 is received in the opening 2A in the housing 2. The base 22 of the holder 19 sits flush to the outer collar 12 which acts as a supporting element that supports the holder 19.

When the fragrance cartridge 10 is inserted into the cavity 16, the peripheral wall 23 of the holder 19 is urged against the base 18B of the valve plunger 18 such that the base 18B is urged towards the lip 13B of the inner collar 13, against the force of the spring 15. This causes the valve head 17, which is connected to the valve plunger 18, to move away from the valve seat 13C such that the valve member 14 moves to an open position (shown in FIG. 5). More specifically, the cumulative lengths of the valve plunger 18 and the peripheral wall 23 of the fragrance cartridge 10 in the direction of the central axis A-A of the cavity 16 are such that the base 17B of the valve head 17 is spaced from the valve seat 13C when the base 22 of the holder 19 is received in the opening 2A in the housing 2.

Steam is able to flow between the steam channel 8 and the cavity 16 when the valve member 14 is in the open position such that fragrance is imparted to the steam from the fragrance receiving element 21. More specifically, steam flows from the steam channel 8 and through a gap between the valve head 17 and the valve seat 13C. The steam then flows through the space between the connecting members 18C of the valve plunger 18 and through the aperture 18D in the base 18B of the valve plunger 18 to enter the cavity 16. The steam in the cavity 16 comes into contact with the fragrance receiving element 21 and then flows back out of the cavity 16, through the valve plunger 18 and the gap between the valve head 17 and the valve seat 13C, and back into the steam channel 8.

The fragrance receiving element 21 is thus fluidly communicated with the steam channel 8 when the fragrance cartridge 10 is received in the cavity 16. Thus, the fragrance absorbed in the fragrance receiving element 21 is released into the steam that flows into the cavity 16. The steam then flows out of the cavity 16 and back into the steam channel 8. The steam is then vented through the plurality of steam vents 5 and onto the garment to be steamed such that the fragrance is imparted onto the garment.

The peripheral wall 23 of the holder 19 comprises a protrusion structure 29. The protrusion structure 29 is in the form of a plurality of protrusions 29A that are distal to the base 22 of the holder 19 such that the protrusions 29A abut the base 18B of the valve plunger 18 when the fragrance cartridge 10 is received in the cavity 16. The protrusions 29A define a plurality of spaces 29B that are located between adjacent protrusions 29A. The spaces 29B are disposed about the periphery of the fragrance receiving element 21 to increase the surface area of the fragrance receiving element 21 that is in contact with the steam in the cavity 16. The spaces 29B also facilitate circulation of steam in the cavity 16. Thus, the protrusion structure 29 increases the rate at which fragrance is imparted to the steam in the cavity 16.

With the fragrance cartridge 10 received in the cavity 16 such that the first and second locking protrusions 25 are received in the first and second locking recesses 26, the user moves the handle 20 to the stowed position. Thus, the locking means holds the fragrance cartridge 10 in place in the cavity 16. Furthermore, the first and second latch elements 28A, 28B engage to prevent the handle 20 from being unintentionally moved back to the extended position, thus reducing the likelihood of accidental removal of the fragrance cartridge 10 from the cavity 16.

The fragrance cartridge 10 is configured to prevent steam from escaping out of the cavity 16 via the opening 2A in the housing 2 when the fragrance cartridge 10 is received in the cavity 16. In the present embodiment, a seal 30 is provided that is configured to seal between the inner collar 13 and the peripheral wall 23 of the holder 19 when the fragrance cartridge 10 is received in the cavity 16. The seal 30 is in the form of an annular sealing gasket 30 that extends radially inwardly from the peripheral wall 13A of the inner collar 13 towards the central axis A-A of the cavity 16. The seal 30 is proximate to the outer collar 12 such that the seal 30 is spaced from the lip 13B of the inner collar 13. Thus, when the fragrance cartridge 10 is received in the cavity 16, the seal 30 abuts the peripheral wall 23 of the holder 19 such that steam is prevented from flowing out of the cavity 16 via the aperture 12A in the outer collar 12 and the opening 2A in the housing 2. In an alternative embodiment (not shown), the seal is instead attached to the peripheral wall of the holder to abut the peripheral wall of the inner collar when the fragrance cartridge is received in the cavity. In yet another embodiment (not shown), the seal is omitted and instead a portion of the peripheral wall of the holder abuts a portion of the peripheral wall of the inner collar when the fragrance cartridge is received in the cavity to form a seal therebetween.

The fragrance cartridge 10 can be removed from the cavity 16 to allow the user to access the fragrance receiving element 21. Therefore, the user can easily replenish the amount of fragrance absorbed in the fragrance receiving element 21. In addition, the fragrance receiving element 21 can be substituted with another fragrance receiving element (now shown) that is used to absorb a different fragrance. Therefore, mixing of different fragrances is prevented and there is no need for all of the fragrance in the fragrance receiving element 21 to be depleted before a different fragrance is used.

To remove the fragrance cartridge 10 from the cavity 16, the user moves the handle 20 from the stowed position to the extended position, by exerting sufficient force on the handle 20 to disengage the first and second latch elements 28A, 28B. Once the handle 20 is in the extended position, the first and second locking recesses 26 are orientated such that the first and second locking protrusions 25 can be removed therefrom and so the fragrance cartridge 10 can easily be removed from the cavity 16. When the fragrance cartridge 10 is removed from the cavity 16, the valve member 14 is urged back to the closed position (shown in FIG. 4) by the retaining member 15 such that the valve head 17 is located against the valve seat 13C and thus steam is prevented from flowing out of the steam channel 8 and into the steam cavity 16. This is advantageous since otherwise hot steam would be able to escape out of the opening 2A in the housing 2 to potentially burn the user.

Figure 9:
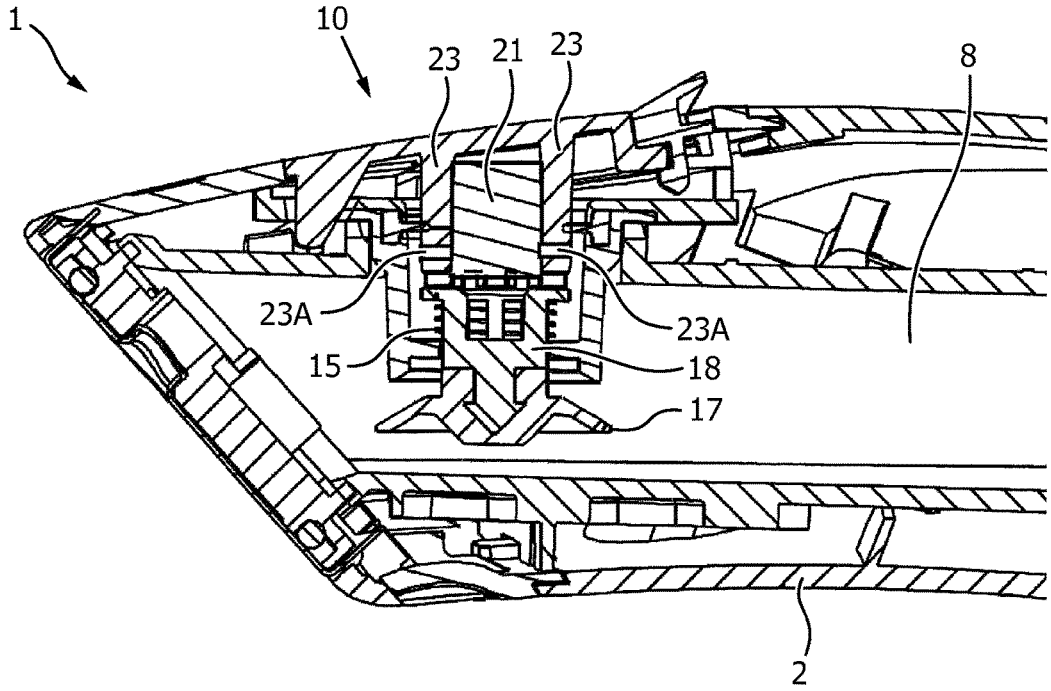
FIG. 9 is a cross-sectional side view of a garment steaming device according to another embodiment of the invention; and, FIG. 10 is a cross-sectional side view of a garment steaming device according to yet another embodiment of the invention.

In the above described embodiment, the peripheral wall 23 of the holder 19 comprises a protrusion structure 29 that is configured to increase the surface area of the fragrance receiving element 21 that is in contact with the steam in the cavity 16. This increases the rate at which fragrance is imparted to the steam in the cavity 16. However, it should be recognised that the protrusion structure 29 may be omitted. In one alternative embodiment (shown in FIG. 9), the peripheral wall 23 of the holder 19 comprises a plurality of apertures 23A that extend through the thickness of the peripheral wall 23. Therefore, the portions of the fragrance receiving element 21 proximate to the apertures 23A are exposed to the steam in the cavity 16 to increase the surface area of the fragrance receiving element 21 that is in contact with the steam. In another alternative embodiment (not shown), the peripheral wall comprises one aperture.

Figure 10:
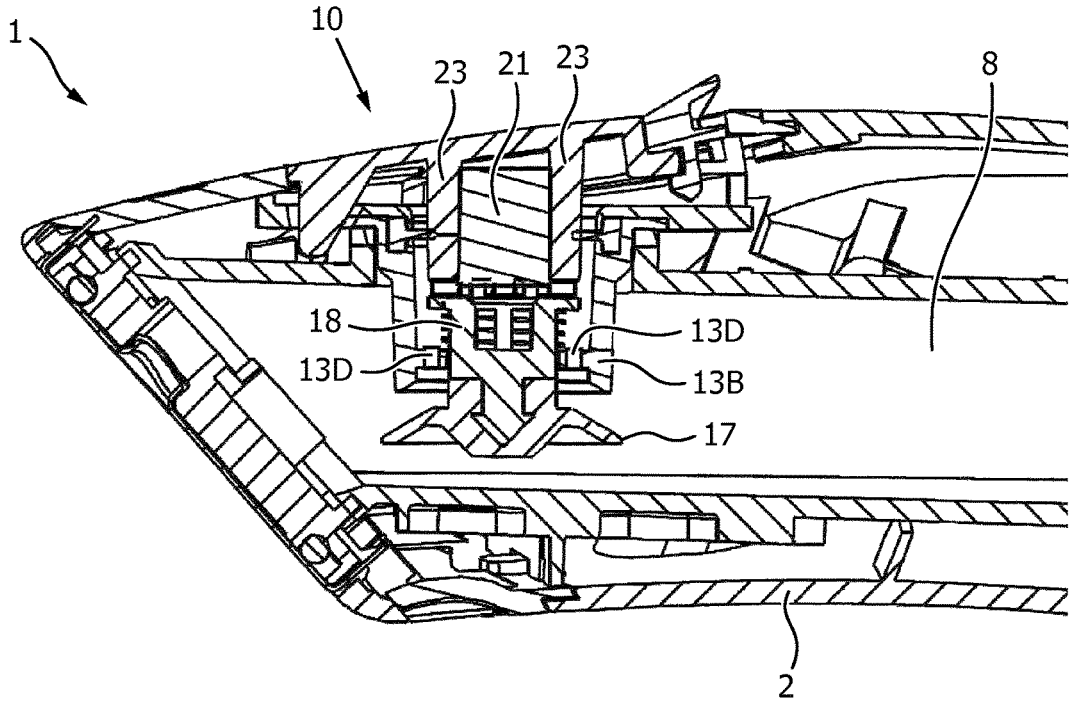

In the above described embodiment, the valve plunger 18 comprises a hollow structure that allows for steam to flow between the steam channel 8 and the cavity 16 when the valve member 14 is in the open position (as shown in FIG. 5). In an alternative embodiment (shown in FIG. 10), the lip 13B of the inner collar 13 comprises a plurality of apertures 13D that allow for steam to flow between the steam channel 8 and the cavity 16 when the valve member 14 is in the open position. In another alternative embodiment (not shown), the inner collar comprises one aperture. In yet another embodiment (not shown), a gap is provided between the valve member and the lip of the inner collar such that steam can flow through said gap when the valve member is in the open position.

Although in the above described embodiments the outer and inner collars 12, 13 are separate components, in an alternative embodiment (not shown) the outer and inner collars are integrally formed. In one embodiment, the outer and/or inner collar is integrally formed with the housing of the garment steaming device.

Although in the above described embodiments the body 3 comprises first and second portions 3A, 3B that are attached together and to the steam nozzle 4 to form the housing 2, in alternative embodiments (not shown), the first and second portions of the body and/or the steam nozzle are integrally formed.

Although in the above described embodiments the opening 2A in the housing 2 is an aperture in the steam nozzle 4, in an alternative embodiment (not shown) the opening in the housing is an aperture in the body.

In the above described embodiments the cavity 16 extends into the steam nozzle 4 of the housing 2 such that the fragrance cartridge 10 is received in the housing 2 to impart fragrance to the steam. However, in alternative embodiments (not shown), the cavity 16 instead extends into the body 3 such that the fragrance cartridge 10 is received in the body 3 to impart fragrance to the steam. Alternatively, a portion of the steam hose may comprise a housing with a steam channel that extends therethrough. The housing has a cavity and the fragrance cartridge is received in the cavity to impart fragrance to the steam flowing through the steam hose. In yet another embodiment (not shown), the steaming device comprises a base unit that houses the steam generator, and the steam hose fluidly communicates the base unit with the steam channel in the garment steaming device. The cavity extends into the base unit such that the fragrance is imparted to the steam in the steam generator.

Although in the above described embodiment the retention member 15 comprises a helical spring, in alternative embodiments (not shown) the garment steaming device comprises a different type of retention member. For example, the retention member may instead comprise a different type of spring or a portion of resilient material that is compressed between the lip of the inner collar and the base of the valve plunger to bias the valve member into the closed position. In one alternative embodiment (not shown), the retaining member is disposed between the lip of the inner collar and the base of the valve head such that the retaining member is under tension when the valve member is moved to the open position.

Although in the above described embodiment the garment steaming device 1 is a steamer head 1, it shall be recognised that other types of garment steaming device are intended to fall within the scope of the invention. For instance, in an alternative embodiment (not shown), the garment steaming device is a steam iron.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A garment steaming device comprising:

a housing having a nozzle;

a steam channel arranged in the housing for the passage of steam, wherein the steam channel includes a steam duct that extends within the housing to convey steam, supplied via a steam generator, to the nozzle;

a cavity extending into the steam channel;

a fragrance cartridge removeably disposed in the cavity; and, a valve assembly disposed between the cavity and the steam channel, wherein the valve assembly includes a valve member operable between a closed position and an open position, wherein the closed position of the valve member is operable to close the cavity to the steam channel to prevent steam from flowing interactively between the steam channel and the cavity in response to the fragrance cartridge not being disposed in the cavity, and wherein the fragrance cartridge is operable to urge valve member of the valve assembly to open the cavity to the steam channel to allow steam to flow interactively between the steam channel and the cavity in response to the fragrance cartridge being disposed in the cavity.

2. The garment steaming device according to claim 1, wherein the valve assembly further comprises a valve seat, the valve member being movable to take a first position in which the valve member is away from the valve seat to allow steam to flow between the steam channel and the cavity, and a second position in which the valve member is in contact with the valve seat to prevent steam from flowing between the steam channel and the cavity.

3. The garment steaming device according to claim 2, wherein the valve member comprises a valve head arranged at an end of the valve member proximate to the steam channel, wherein the valve head is configured to contact the valve seat to prevent steam from flowing between the steam channel and the cavity when the valve member is in said second position.

4. The garment steaming device according to claim 3, wherein the valve assembly further comprises a retention member to maintain the valve head in contact with the valve seat when the valve member is in said second position.

5. The garment steaming device according to claim 4, wherein the retention member comprises a spring.

6. The garment steaming device according to claim 2, wherein the valve member comprises a hollow structure to carry steam between the steam channel and the cavity.

7. The garment steaming device according to claim 1, further comprising a supporting element, wherein the supporting element is disposed at an end of the cavity distal to the steam channel, and wherein the fragrance cartridge abuts the supporting element in response to the fragrance cartridge being disposed in the cavity.

8. The garment steaming device according to claim 1, wherein the fragrance cartridge comprises a fragrance receiving element and a holder to hold the fragrance receiving element.

9. The garment steaming device according to claim 8, wherein the holder comprises a peripheral wall that extends in the cavity in response to the fragrance cartridge being received in the cavity, wherein the peripheral wall defines a recess for receiving the fragrance receiving element.

10. The garment steaming device according to claim 9, wherein the valve member comprises a valve plunger for extending into the cavity, the valve plunger and the peripheral wall of the holder having cumulated lengths along a central axis (A-A) of the cavity, wherein the fragrance cartridge urges the valve head away from the valve seat in response to the valve member being in the first position.

11. The garment steaming device according to claim 10, wherein the peripheral wall of the holder comprises a protrusion structure at an end facing the plunger, the protrusion structure forming an opening for steam to contact the fragrance receiving element in response to the peripheral wall of the holder being in contact with the plunger, further in response to the valve member being in the first position.

12. The garment steaming device according to claim 9, wherein the peripheral wall of the holder comprises at least one hole forming an opening for steam to contact the fragrance receiving element in response to the valve member being in the first position.

13. The garment steaming device according to claim 9, further comprising a shoulder element to retain the retention member, wherein the shoulder element includes at least one hole forming an opening to allow steam to flow between the steam channel and the cavity.

14. The garment steaming device according to claim 8, wherein the fragrance cartridge comprises a handle that is hingedly attached to the holder.

15. The garment steaming device according to claim 1, further comprising a locking means to lock the fragrance cartridge in the cavity.

* * * * *